US007419141B2

(12) United States Patent
Wall

(10) Patent No.: US 7,419,141 B2
(45) Date of Patent: Sep. 2, 2008

(54) SOLID BARRIER SYSTEM

(76) Inventor: Michael D. Wall, 1406 Transue Ave., Burton, MI (US) 48509

( * ) Notice: Subject to any disclaimer, the term of this patent is extended or adjusted under 35 U.S.C. 154(b) by 0 days.

(21) Appl. No.: 11/798,419

(22) Filed: May 14, 2007

(65) Prior Publication Data

US 2007/0215851 A1 Sep. 20, 2007

Related U.S. Application Data

(62) Division of application No. 10/815,829, filed on Apr. 2, 2004, now Pat. No. 7,216,853.

(60) Provisional application No. 60/459,965, filed on Apr. 4, 2003.

(51) Int. Cl.
*E04H 17/18* (2006.01)

(52) U.S. Cl. ..... 256/24; 256/65.02

(58) Field of Classification Search ..... 256/1, 256/19, 21, 24, 59, 66, 65.14, 65.15, 65.01, 256/73, DIG. 5; 52/630
See application file for complete search history.

(56) References Cited

U.S. PATENT DOCUMENTS 2,202,745 A * 5/1940 Muse ..... 52/285.2
3,170,201 A * 2/1965 Nofziger ..... 52/732.2
3,363,386 A * 1/1968 Elflein et al. ..... 52/578
3,506,243 A * 4/1970 Seiler ..... 256/59
3,704,861 A 12/1972 Glaesener ..... 256/13.1
3,728,837 A * 4/1973 Kiefer, Jr. ..... 52/732.2
3,780,481 A * 12/1973 Tomkins ..... 52/265
4,240,615 A * 12/1980 Sickler ..... 256/60
4,266,757 A 5/1981 Kirkwood
4,329,079 A * 5/1982 Milding ..... 403/319
4,498,660 A * 2/1985 Brema et al. ..... 256/19
4,722,633 A * 2/1988 Bergheim et al. ..... 403/277
4,915,537 A * 4/1990 Bergheim et al. ..... 403/277
4,958,807 A * 9/1990 Wylie ..... 256/65.03
4,962,914 A 10/1990 Taylor ..... 256/72
5,149,061 A * 9/1992 Borgnini ..... 256/24
5,272,850 A * 12/1993 Mysliwiec et al. ..... 52/582.2
5,317,848 A * 6/1994 Abbey ..... 52/284
5,400,563 A * 3/1995 House et al. ..... 52/745.1
5,402,988 A 4/1995 Eisele
5,480,126 A * 1/1996 Teasdale ..... 256/19
5,492,429 A * 2/1996 Hodges ..... 403/372
5,529,289 A 6/1996 Lancer
5,556,080 A 9/1996 Vise
5,560,588 A * 10/1996 Hilliard ..... 256/65.06
5,581,969 A * 12/1996 Kelleher ..... 52/602
5,649,689 A 7/1997 Wilson
5,913,781 A * 6/1999 Vidmar et al. ..... 52/102

(Continued)

*Primary Examiner*—Daniel P. Stodola
*Assistant Examiner*—Joshua T Kennedy
(74) *Attorney, Agent, or Firm*—Ricahrd C. Ltman

(57) ABSTRACT

A solid barrier, sound partition and privacy fence system including a plurality of interconnected fence panels whose ends are adapted to fit to pre-existing fence posts. The ends of the fence panels include attachment structure for releasably securing adjacent fence panels to one another around an existing fence post. The privacy fence system provides for installing a privacy fence that reuses existing cement anchored fence posts. The attachment structure may comprise either an interlocking fastening device or a threaded fastening device. The privacy fence may also include an optional fence post cap that is attached to the top portion of the existing poles. Each fence panel is constructed of a lightweight, one piece, molded material.

5 Claims, 17 Drawing Sheets

U.S. PATENT DOCUMENTS

| | | | | |
|---|---|---|---|---|
| 6,152,428 | A | 11/2000 | Simioni | |
| 6,260,828 | B1 | 7/2001 | English | |
| D465,286 | S * | 11/2002 | Gregori | D25/38 |
| 6,595,497 | B1 * | 7/2003 | Linford et al. | 256/19 |
| 6,609,702 | B1 | 8/2003 | Steffes | 256/1 |
| 6,877,721 | B2 * | 4/2005 | Calverley | 256/24 |
| 2002/0011594 | A1 * | 1/2002 | DeSouza | 256/19 |
| 2004/0025426 | A1 * | 2/2004 | Stefanutti | 47/47 |
| 2004/0036064 | A1 * | 2/2004 | Takagi et al. | 256/65.02 |
| 2004/0217340 | A1 * | 11/2004 | Bergdoll | 256/32 |
| 2007/0170412 | A1 * | 7/2007 | Lee | 256/59 |

* cited by examiner

SOLID BARRIER SYSTEM

CROSS-REFERENCE TO RELATED APPLICATIONS

This application is a division of application Ser. No. 10/815,829 filed Apr. 2, 2004, now U.S. Pat. No. 7,216,853, which claims the benefit of U.S. Provisional Patent Application Ser. No. 60/459,965, filed Apr. 4, 2003.

BACKGROUND OF THE INVENTION

1. Field of the Invention

The present invention relates to solid barriers, sound partitions, privacy fences and, more particularly, to barrier systems that may be attached to cement anchored posts from a preexisting cyclone fence.

2. Description of Related Art

Many homeowners have standard cyclone fences around their yards. A standard cyclone fence can keep unwanted visitors off of the property. A cyclone fence, however, does not provide much privacy for the user. The structure of a cyclone fence allows outsiders to look through the fence and see what is located in the yard.

There are several common types of privacy fences that prevent outsiders from looking into the area surrounded by the fence, thus providing the user with a heightened degree of privacy. Examples of common fences are described in the following patent documents.

U.S. Pat. No. 4,266,757 issued to Kirkwood discloses a corner fence post clip. The invention is a device for attaching horizontal fence rails or a fence panel to tubular fence post. The device is an attachment member equipped with a top section in the shape of a hook that engages the open top of a tubular fence post. The attachment member is further equipped with a plurality of U-shaped clips that are adapted to receive the fence rails or panels.

U.S. Pat. No. 5,402,988 issued to Eisele discloses a portable fence. The portable frame comprises a frame supporting a fencing net. A base element engages the bottom of the fence and holds it in a vertical position. A collapsible mechanism attaches the base element to the frame and permits the base to disengage from the frame on application of a predetermined force to the frame.

U.S. Pat. No. 5,529,289 issued to Lancer, Sr. discloses a plastic multi-functional privacy fence. The fence is comprised of vertical slats that interlock along each adjacent edge to create an effective barrier against intrusions. The vertical slats are interlocked at mating seams and are attached to a frame that provides rigidity to the fence. The frame is comprised of horizontal rails that are attached by fasteners to vertical posts that are anchored to the ground.

U.S. Pat. No. 5,556,080 issued to Vise discloses a fence system that includes a frame and a plurality of panels attached to the frame. The frame includes vertical posts and non-vertical rails. Adjacent panels are positioned on the frame to provide an overlapping area. A reinforcing member is positioned on the overlapping area. A fastener extends through the overlapping area of two panels to attach the panels to the frame.

U.S. Pat. No. 5,649,689 issued to Wilson discloses a flexible and detachable fence apparatus. The fence comprises fence panels for providing a barrier, posts for vertically supporting the fence panels and posthole inserts for securing the fence to the ground. The fence panel is equipped with a connector means for securing the fence panel to the posts. The posts have receptacle means for receiving and interlocking with the connector means of the fence panel. Preferably, the connector means and receptacle means provide a mechanism for detachably securing the fence panel to the posts.

U.S. Pat. No. 6,152,428 issued to Simioni discloses a fence system including a plurality of wooden posts encased in sections of vinyl eaves, a frame constructed of galvanized track and stud elements, J-strips located on each end of the frame abutting the posts, and vertical panels formed of vinyl siding connected to each other and to the frame between the posts.

U.S. Pat. No. 6,260,828 to English comprises a prefabricated interlocking fence post. The interlocking fence post includes slots that slidably receive adjoining fence panels. A cap may be secured to the top of the post after the panel is slid into position. An L-shaped bracket on the outside of the post slot may be rigidly clamped to provide a variable-height attachment site for horizontal support rails.

The problem with existing privacy fences is that they are usually difficult to assemble. Another problem with the privacy fences occurs when a homeowner already has a preexisting cyclone fence in place and wants to replace it with a privacy fence. Normally the preexisting fence must be completely disassembled and removed before the new fence can be assembled. Then the homeowner must erect the new fence. This is both time-consuming and expensive. It would be much more efficient to adapt the existing fence into a privacy fence.

Therefore what is needed is a privacy fence system that can reuse the existing fence posts from the previous fence. What is further needed is a privacy fence system that can easily be assembled by a single person with common hand tools. What is still further needed is a privacy fence system that can adapt to existing irregularities in placement of existing poles. Finally, what is still further needed is a privacy fence system that can be non-destructably disassembled and moved.

None of the above inventions and patents, taken either singly or in combination, is seen to describe the instant invention as claimed.

SUMMARY OF THE INVENTION

The present invention is a privacy fence system that is attached to the cement anchored posts of a preexisting cyclone fence. When a homeowner has a cyclone fence installed in his yard the chain mesh body portion may be removed while leaving the fence posts in their original position. The present privacy fence system provides a way to install a new privacy fence without having to remove the preexisting posts and replace them with new posts.

The present privacy fence system is made up of a plurality of interconnected fence panels where a first end of each of the fence panels is adapted to fit the fence panels to an existing fence post. The first end of each of the fence panels further comprises an attachment releasably securing adjacent fence panels to one another around an existing fence post. The first end of each of the fence panels comprises a post-receiving cavity. The post-receiving cavity allows adjacent fence panels to fit around a preexisting fence post. The attachment then releasably secures the adjacent fence panels to one another while fit to the fence post.

The second end of each fence panel is adapted to releasably secure each fence panel to another adjacent fence panel, without fitting the adjacent fence panels around a fence post. The second end of each of the fence panels is attached to another adjacent fence panel by a plurality of molded pop rivets. The pop rivet securing allows the adjacent fence panels to overlap one another when they are attached. It is usually necessary to provide a structure for overlapping the adjacent panels to compensate for irregularities of previously misplaced fence posts.

The privacy fence system provides both linear fence panel segments and corner fence panel segments. The fence panels are made from a lightweight, one piece, molded construction. The fence panels may be non-destructably disassembled so that the privacy fence system may be removed and installed in another location.

In one embodiment of the present invention the attachment means comprises an interlocking mechanism. The interlocking mechanism on a first fence panel comprises a plurality of connector slots. The interlocking mechanism on an adjacent fence panel comprises a plurality of connector projections. The connector slots are adapted to receive the connector projections of an adjacent fence panel. When the connector projections are received into the connector slots of an adjacent fence panel, the fence panels are releasably secured to one another around the existing fence post.

In a particular embodiment of the interlocking design, the interlocking mechanism on each fence panel provides both connector slots and connector projections. The top half of each fence panel interlocking mechanism comprises either connector slots or connector projections. The bottom half of each fence panel interlocking mechanism comprises either connector slots or connector projections. For example, a first fence portion has connector projections on the top half of the interlocking mechanism and connector slots on the bottom half. The adjacent fence portion has connector slots on the top half of the interlocking mechanism and connector projections on the bottom half. The first fence panel is lifted to the mid point of the adjacent fence portion and then it is slid into place, connecting the two adjacent fence portions. The alternating configuration of the interlocking mechanism in this embodiment provides a more secure connection and easier assembly.

In the preferred embodiment of the present invention the attachment means comprises a threaded fastener. The fence post receiving slots fit the ends of adjacent fence panels around a fence post. The threaded fastener extends through adjacent ends of the adjacent fence panels, releasably securing said adjacent fence panels to one another around the existing fence post.

The privacy fence system optionally includes a fence post cap. The fence post cap is a rain cap that has a circular base and a plurality of sidepieces forming a pyramidal top portion. The circular base is equipped with a snap-in retainer lip and a compression relief slit that allows the fence post cap to be releasably secured to the top of the fence posts.

Accordingly, the instant invention provides a privacy fence system that can be attached to and reuse the existing fence posts from a previously installed cyclone fence. The system can easily be assembled by a single person with common hand tools and is adaptable to existing irregularities in the placement of the preexisting poles. The system can be non-destructably disassembled and moved.

The present invention presents improved elements and arrangements thereof in an apparatus for the purposes described which are inexpensive, dependable and fully effective in accomplishing their intended purposes.

A clear understanding of the invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
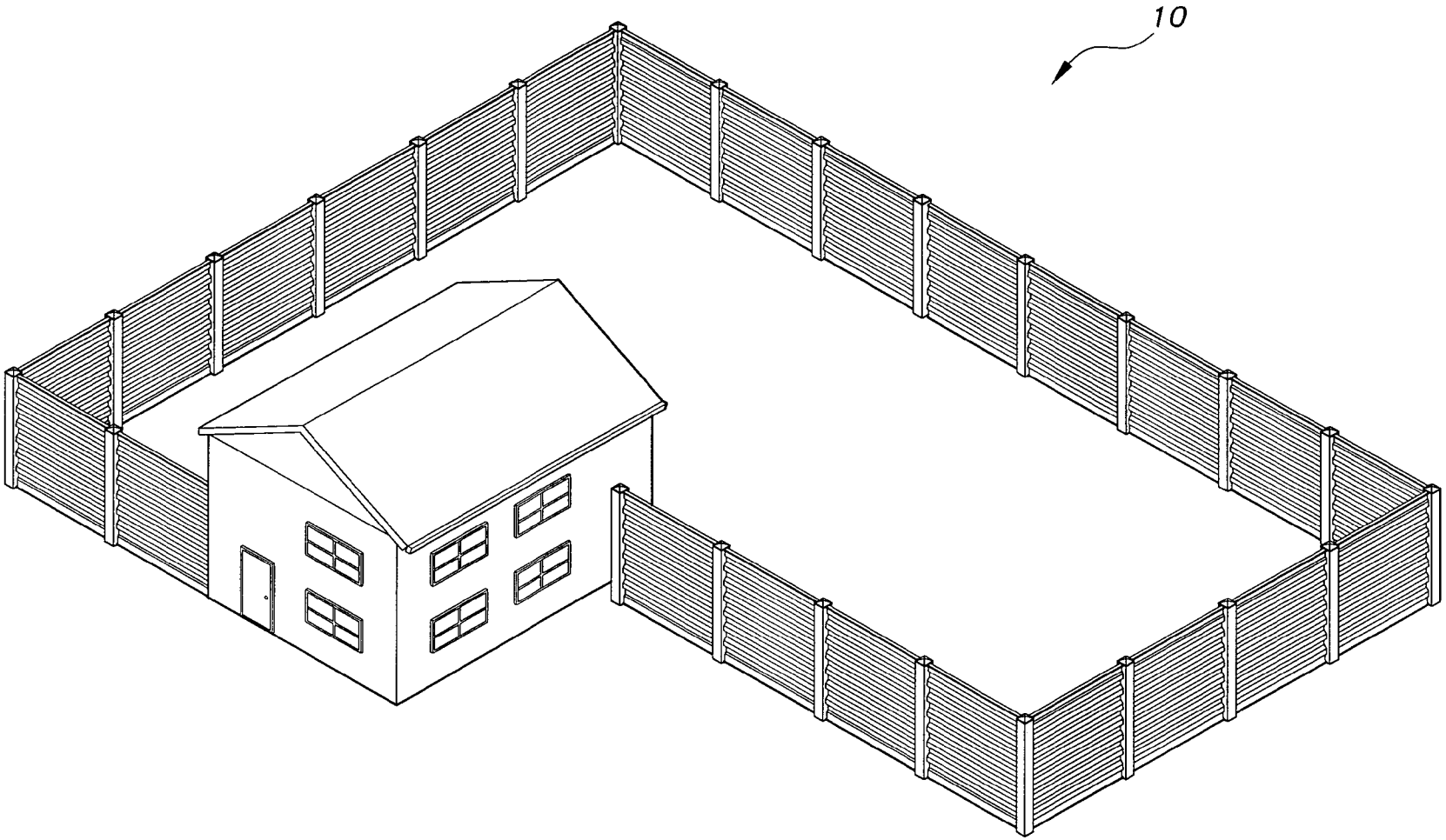
FIG. 1 is an environmental, perspective view of a privacy fence system according to the present invention.

The present invention is a solid barrier system, for use as a privacy fence, which fence replaces an existing cyclone fence while reusing the preexisting fence posts of the cyclone fence. The present privacy fence system allows the user to remove the wire mesh fencing from an installed cyclone fence but leave the cement anchored fence posts in their original places. The privacy fence is adapted to fit onto the preexisting fence posts. The solid barrier system is not limited to the embodiments discussed below but may also be used for any solid barrier or sound partition. FIG. 1 depicts an environmental, perspective view of a privacy fence system 10 according to the present invention.

Figure 2:
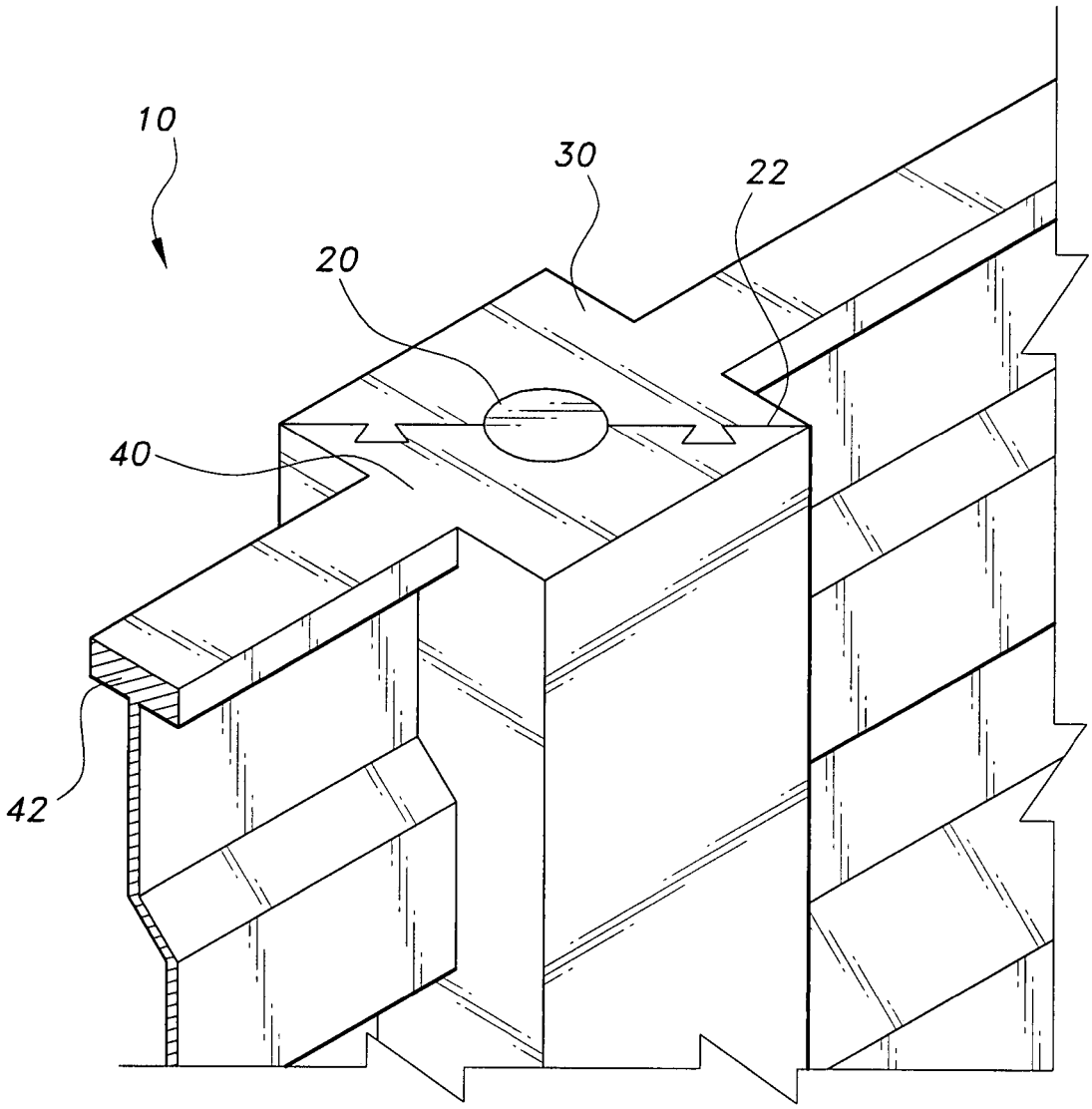
FIG. 2 is an enlarged-scale perspective view of a linear segment of a first embodiment of the privacy fence system depicting adjacent fence panels connected to an existing fence pole.

The privacy fence system 10 comprises a plurality of fence panels with at least one end of the fence panels being adapted to fit around the preexisting fence posts. FIG. 2 depicts a perspective view of a linear segment of a first embodiment of the privacy fence system 10 depicting adjacent fence panels connected to an existing fence post. Adjacent fence panels 30 and 40 are fit around a fence post 20. The seam 22 between the fence panels 30, 40 defines the connection point of the adjacent fence panels 30, 40 around the fence post 20. A first end of each fence panel 30, 40 is adapted to securely fit around the fence post 20. The distal end 42 of the fence panel 40 is not adapted to fit around a fence post 20. The distal end 42 is adapted to releasably attach to the distal end of another adjacent fence panel.

Figure 3:
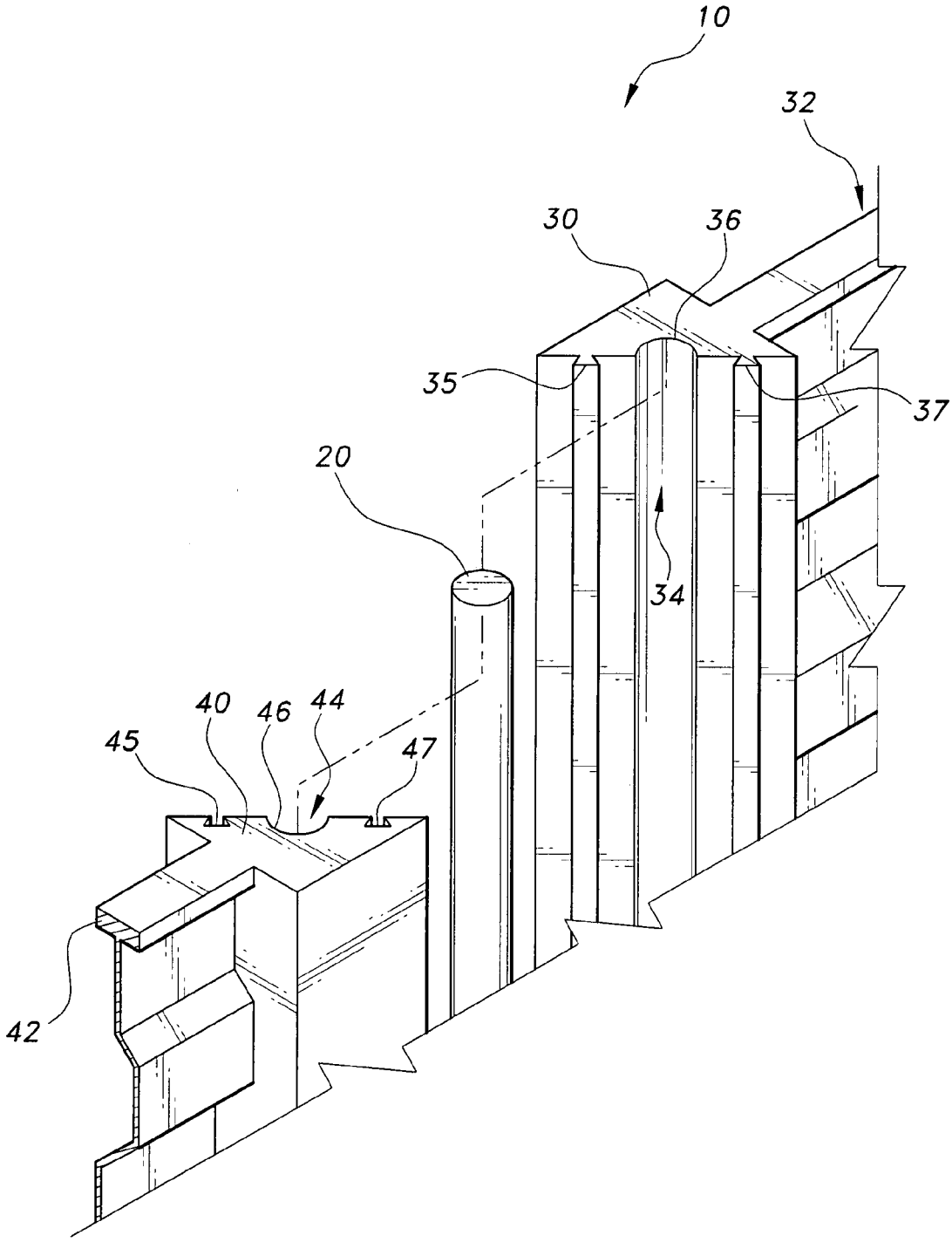
FIG. 3 is an exploded perspective view of a linear segment of the first embodiment of the privacy fence system depicting adjacent fence panels and the existing fence post.

FIG. 3 is an exploded, perspective view of the linear segment of the privacy fence system 10 depicting the fence panel attachment means according to one embodiment of the present invention. A first end 34, 44 of each fence panel provides respective post receiving slots 36, 46, which slots are adapted to fit the fence panels 30, 40 around the fence post 20. The first ends 34, 44 of each fence panel further comprise an attachment means for releasably securing adjacent fence panels 30, 40 together around the existing fence post 20. As shown in FIG. 3, the attachment means comprises an interlocking attachment mechanism. The interlocking attachment mechanism on panel 30 is a plurality of connector projections 35, 37. The interlocking mechanism on an adjacent fence panel 40 is a plurality of connector slots 45, 47, which slots are adapted to receive the connector projections 35, 37 of panel 30. To connect the fence panels, the first fence panel 30 is raised above the top of the adjacent fence panel 40 so that the connector projections 35,37 are aligned with and can slide into the connector slots 45,47. Only the first ends 34, 44 of each fence panel are equipped with the attachment means. The distal ends 32, 42 of each fence panel are adapted to be secured to the distal ends of other adjacent fence panels.

Figure 4:
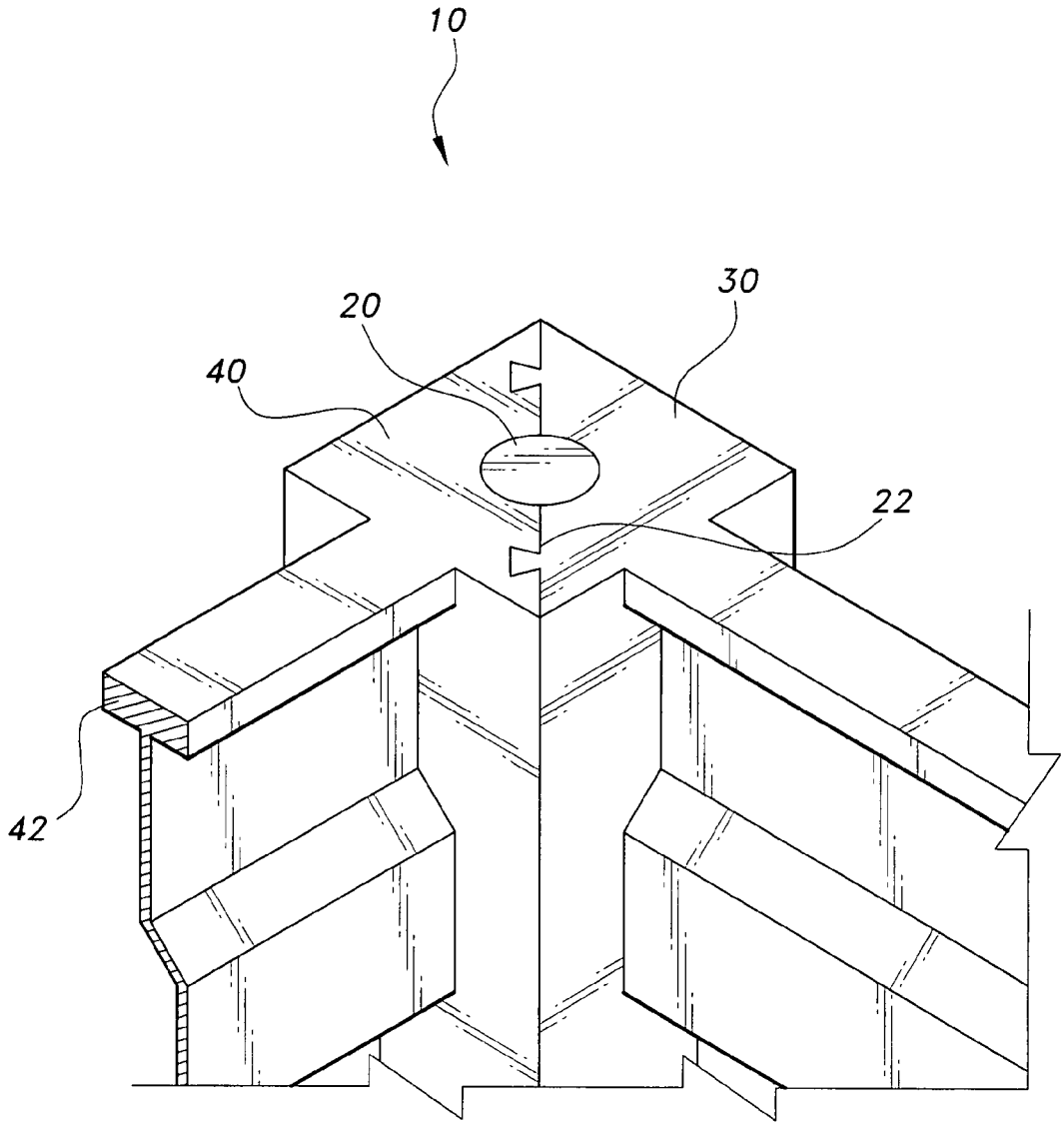
FIG. 4 is a perspective view of a corner segment of the first embodiment of the privacy fence system depicting adjacent corner fence panels attached to the existing fence post.

FIG. 4 is a perspective view of a corner segment of the first embodiment of the privacy fence system 10 depicting adjacent corner fence panels 30, 40 attached to the existing fence post 20. The attachment means for the corner fence panels 30, 40 is identical to that of the linear segments discussed above. The only difference between the corner and linear segments is the position of the attachment means. At a corner fence post, the attachment means are positioned at a different angle so that the adjacent fence panels 30, 40 provide a corner for the fence system 10.

Figure 5:
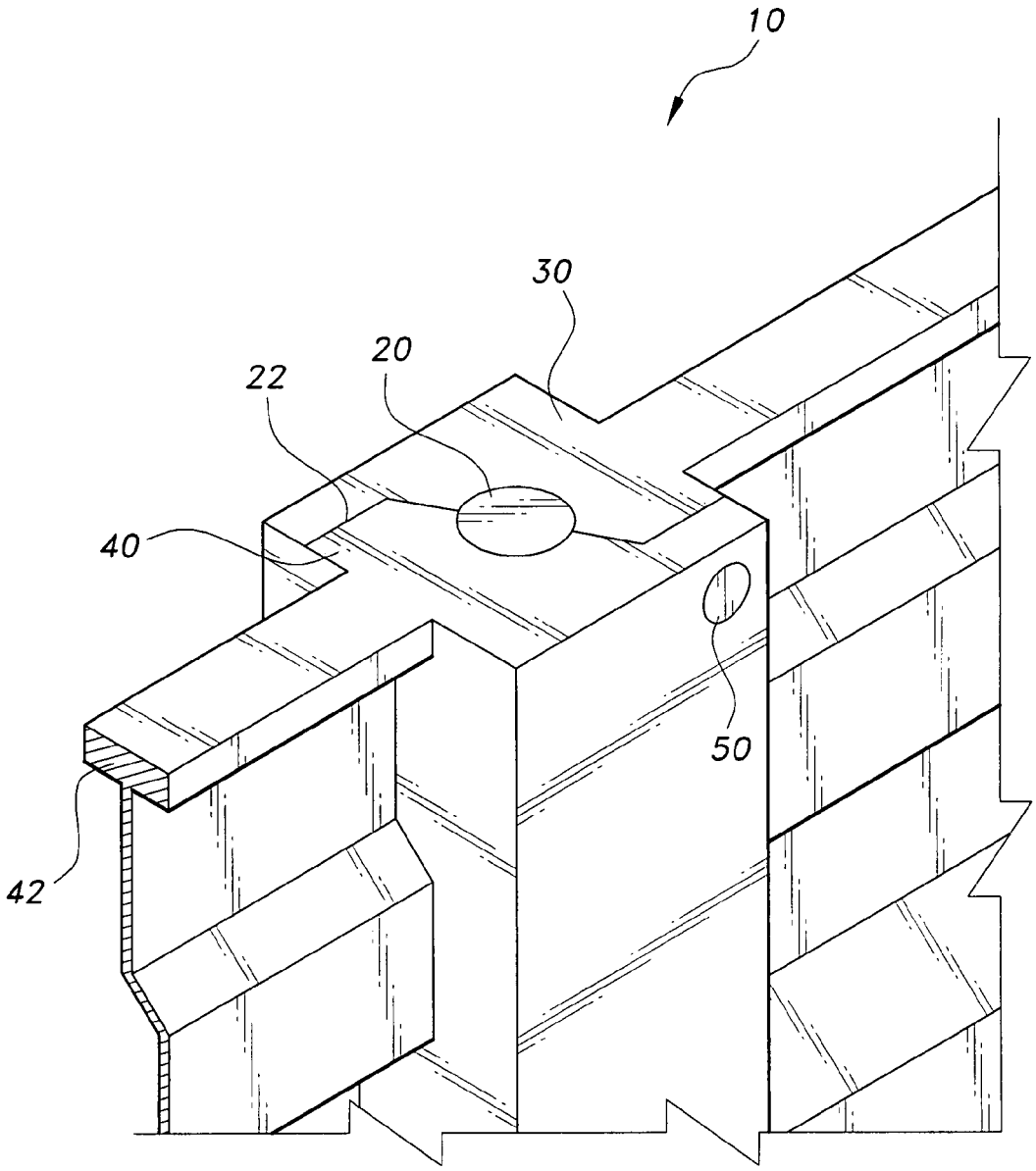
FIG. 5 is a perspective view of a linear segment of the preferred embodiment of the privacy fence system depicting adjacent fence panels connected to an existing fence post.

FIG. 5 is a perspective view of a linear segment of the preferred embodiment of the privacy fence system 10 depicting adjacent fence panels 30, 40 connected to an existing fence post 40. In the preferred embodiment each fence panel 30, 40 is equipped with an attachment means for releasably securing the adjacent fence panels 30, 40 around a fence post 20. The attachment means in the present embodiment comprises a plurality of threaded fasteners 50.

Figure 6:
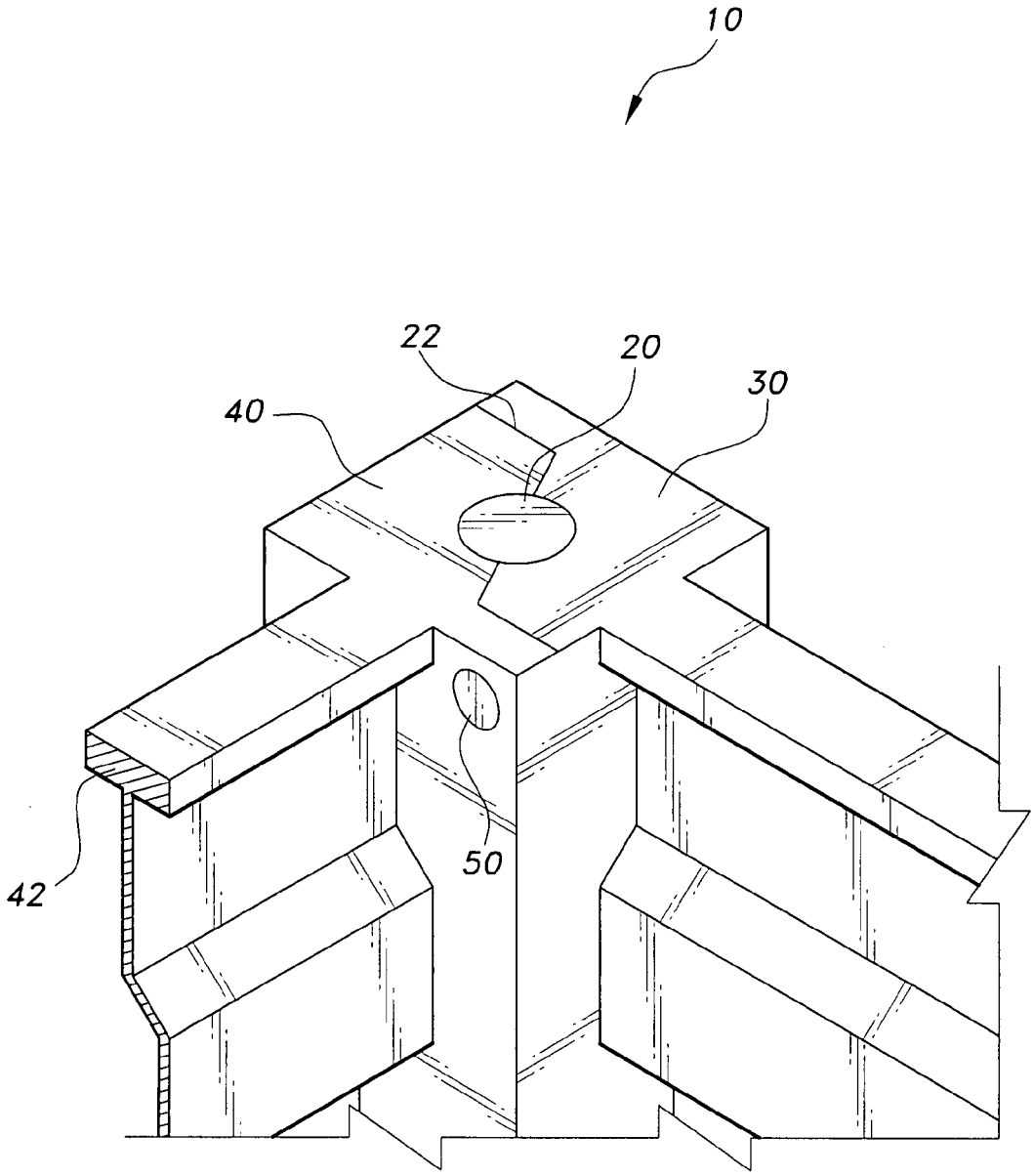
FIG. 6 is a perspective view of a corner segment of the preferred embodiment of the privacy fence system depicting adjacent corner fence panels attached to the existing fence post.

FIG. 6 is a perspective view of a corner segment of the preferred embodiment of the privacy fence system 10 depicting adjacent corner fence panels 30, 40 attached to the existing fence post 20 by the threaded fasteners 50. The threaded fasteners 50 are positioned along the entire height of each fence panel 30, 40. The threaded fasteners 50 are preferably conventional 2 inch wood screws. The fasteners, however, are not limited to conventional wood screws but may take the form of any appropriate fastener.

Figure 7:
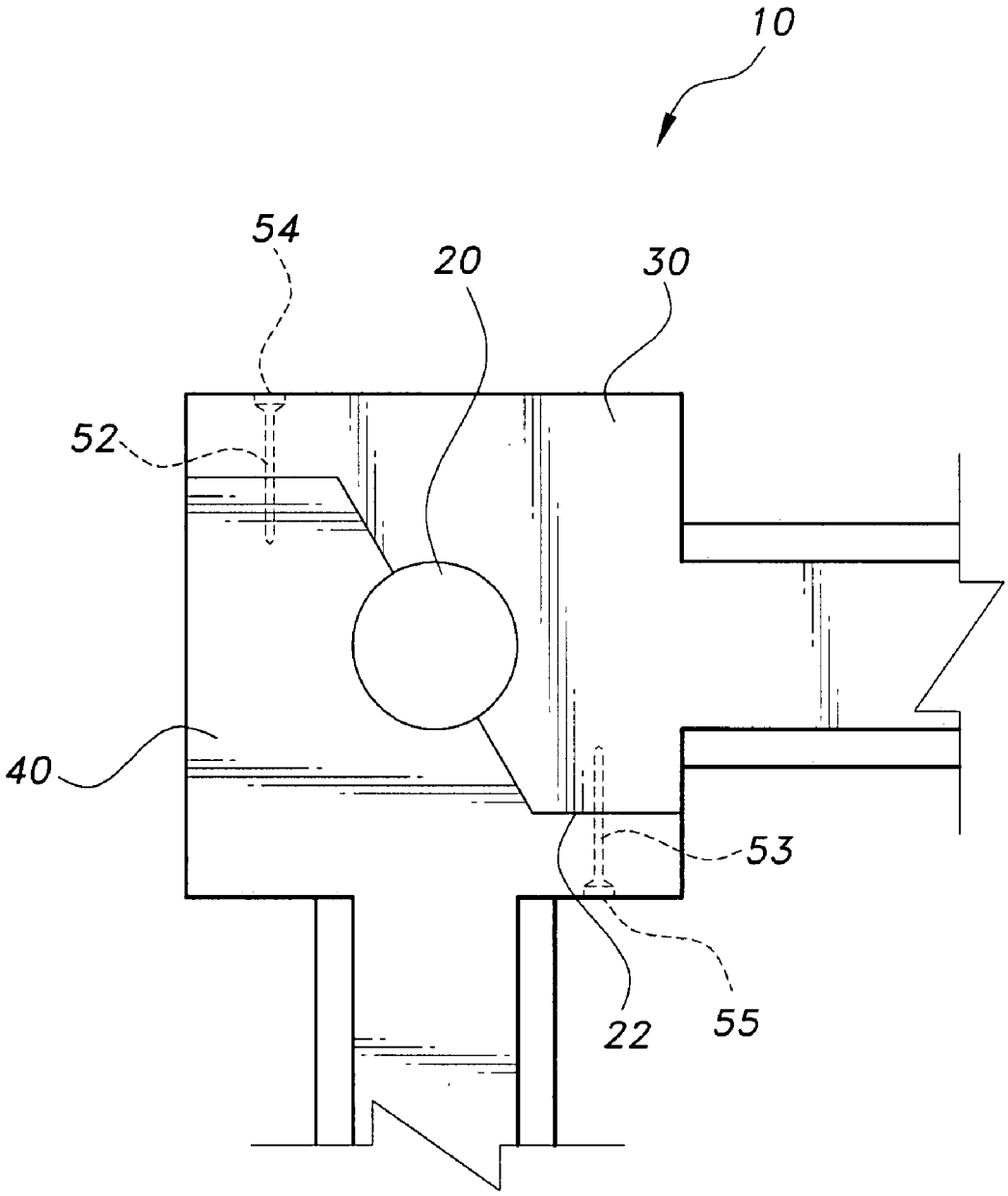
FIG. 7 is a top view of the connection point between adjacent corner fence panels according to the preferred embodiment of the privacy fence system depicting the location of the threaded screw through the fence panels.

FIG. 7 is a top view of the connection point 22 between adjacent corner fence panels 30, 40 according to the second embodiment of the privacy fence system 10 depicting the location of the threaded screws 52, 53 through the fence panels 30, 40. The adjacent fence panels 30, 40 are fitted to a fence post 20 in the same manner as was described in the earlier embodiments. Once the adjacent panels 30, 40 are positioned around the fence post 20 they are releasably secured by the plurality of threaded fasteners 50. Each of the holes created by threaded fasteners 50 is filled with a respective decorative plug 54, 55.

Figure 8:
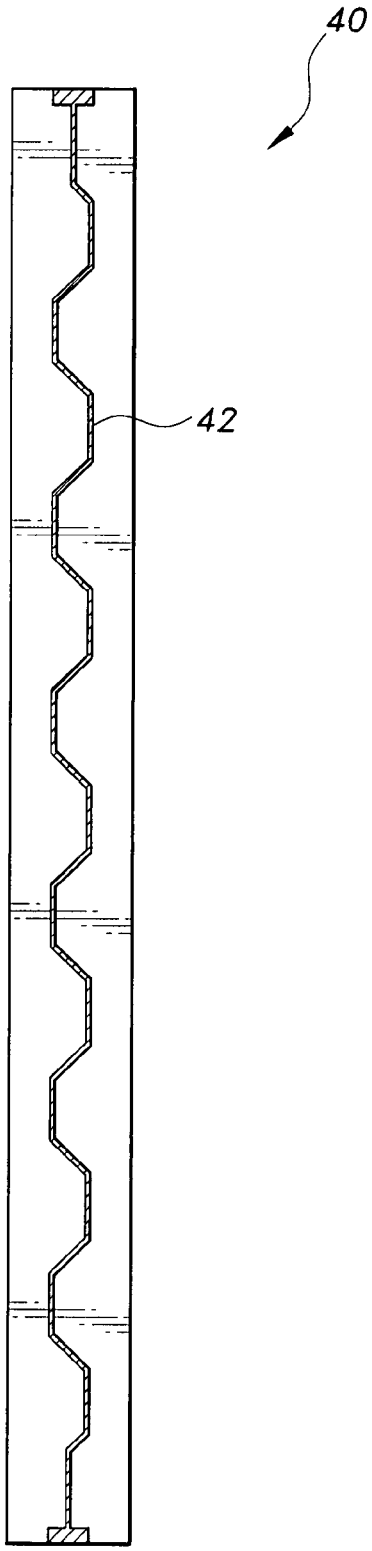
FIG. 8 is a side view of a horizontal corrugated fence panel according to the present privacy fence system.
Figure 8A:
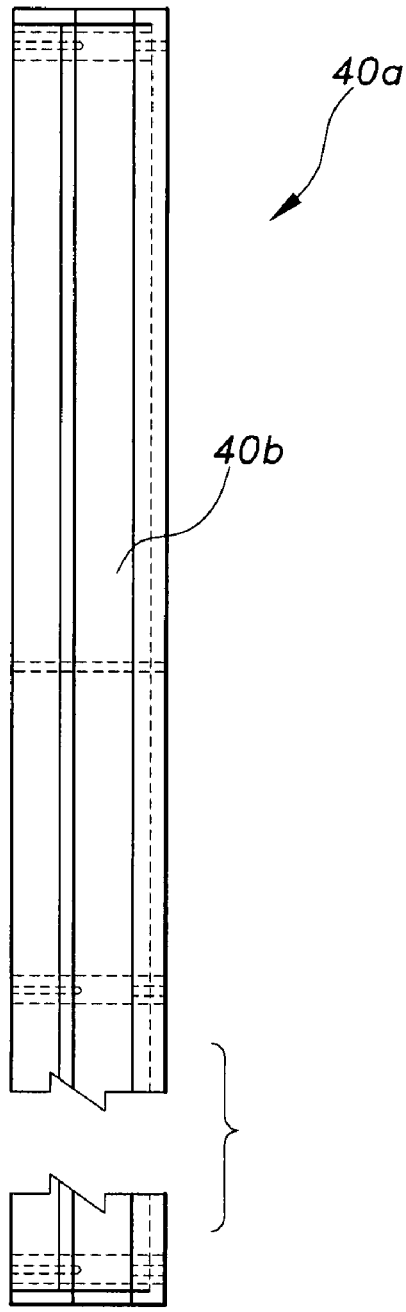
FIG. 8A is a side view of a vertical fence panel design according to the present privacy fence system.

FIG. 8 is a side view of a fence panel 40 according to the present privacy fence system 10. The panel surface is configured to define horizontal corrugations therealong. The corrugated surface provides additional support for the fence panel 40 making it sturdier than if the panel 40 were flat. FIG. 8A is illustrative of an embodiment wherein the fence panel 40*a* has a flat, vertical configuration and is provided with a vertical reinforcing strut 40*b*.

Figure 9:
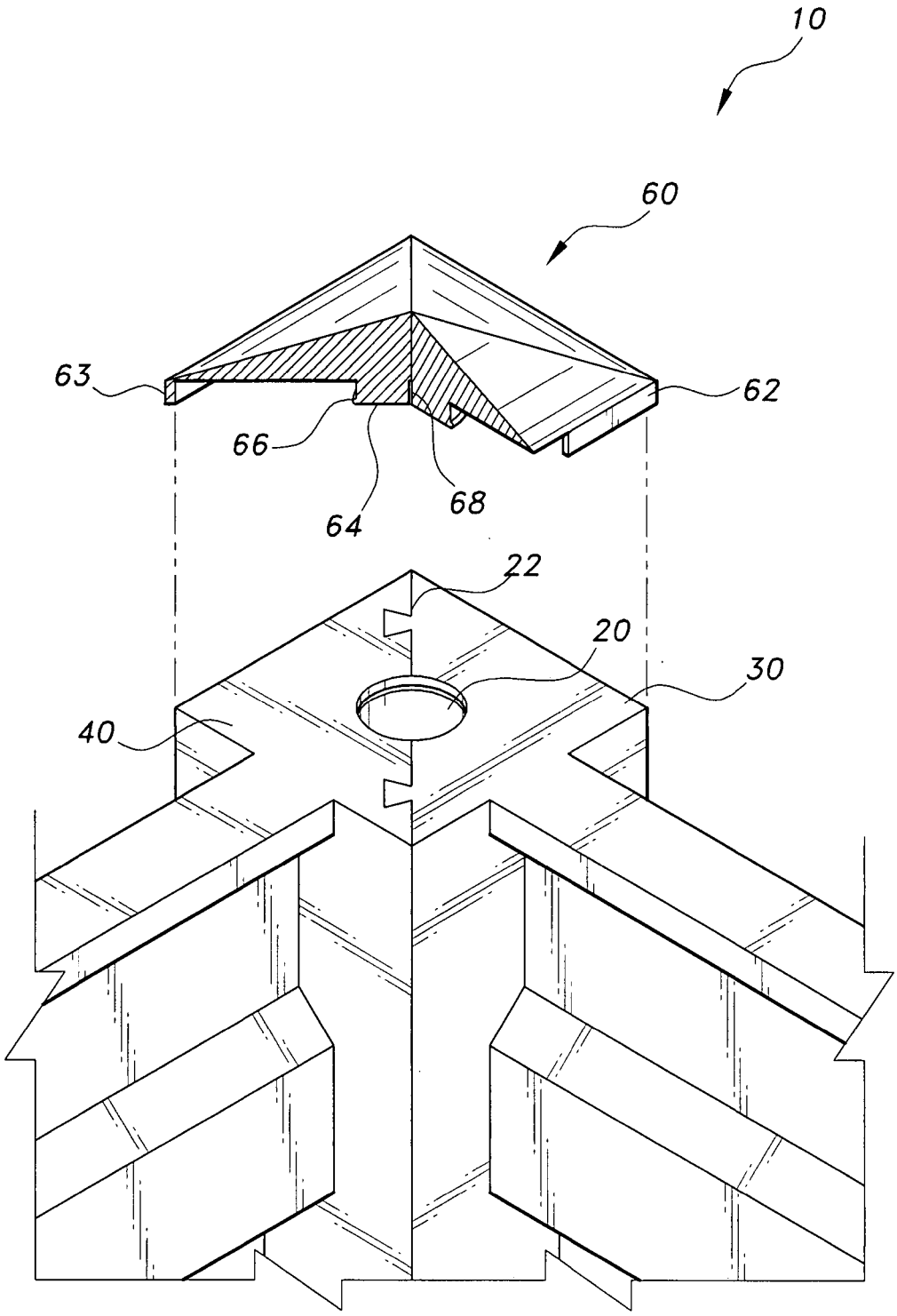
FIG. 9 is a perspective view of a post cap according to the present privacy fence system.
Figure 10:
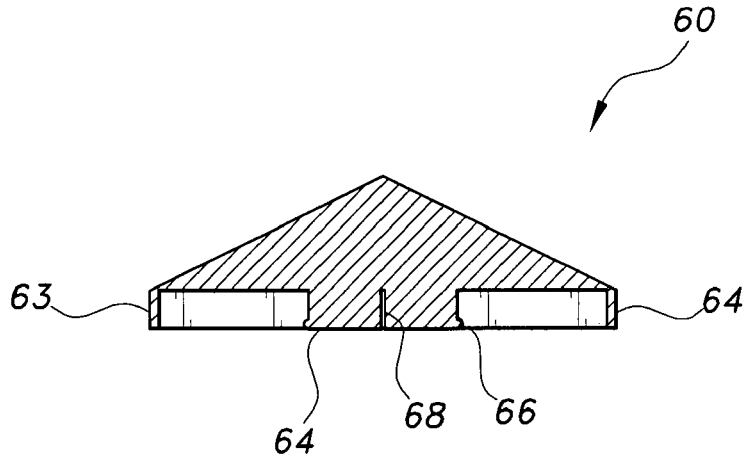
FIG. 10 is a side view of the post cap depicted in FIG. 9.
Figure 11:
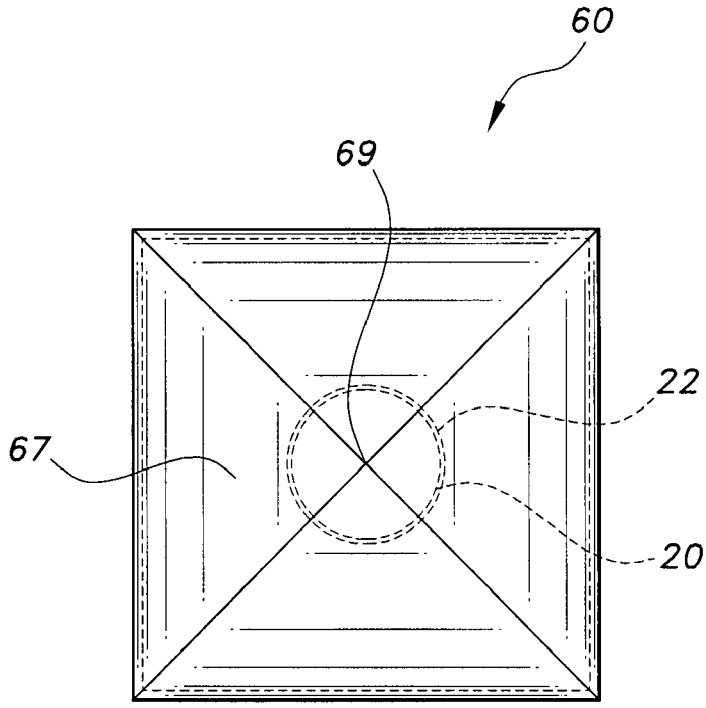
FIG. 11 is a top view of the post cap depicted in FIG. 9.

The privacy fence system 10 optionally comprises a plurality of fence post caps located on the top of the fence posts. FIG. 9 is a perspective view of a post cap 60 according to the present privacy fence system. FIG. 10 is a side view of the post cap depicted in FIG. 9. FIG. 11 is a top view of the post cap depicted in FIG. 9. The fence post cap 60 is a rain cap that has a circular base 64 and a plurality of sidepieces 67 that come to a point 69 forming a pyramidal top portion. The circular base is equipped with a snap-in retainer lip 66 and a compression relief slit 68 that allows the fence post cap 60 to be releasably secured to the top of the fence posts 20. Side members 62, 63 fit around the top portion of each fence panel 30, 40 and hold the fence post cap 60 in place.

Figure 12:
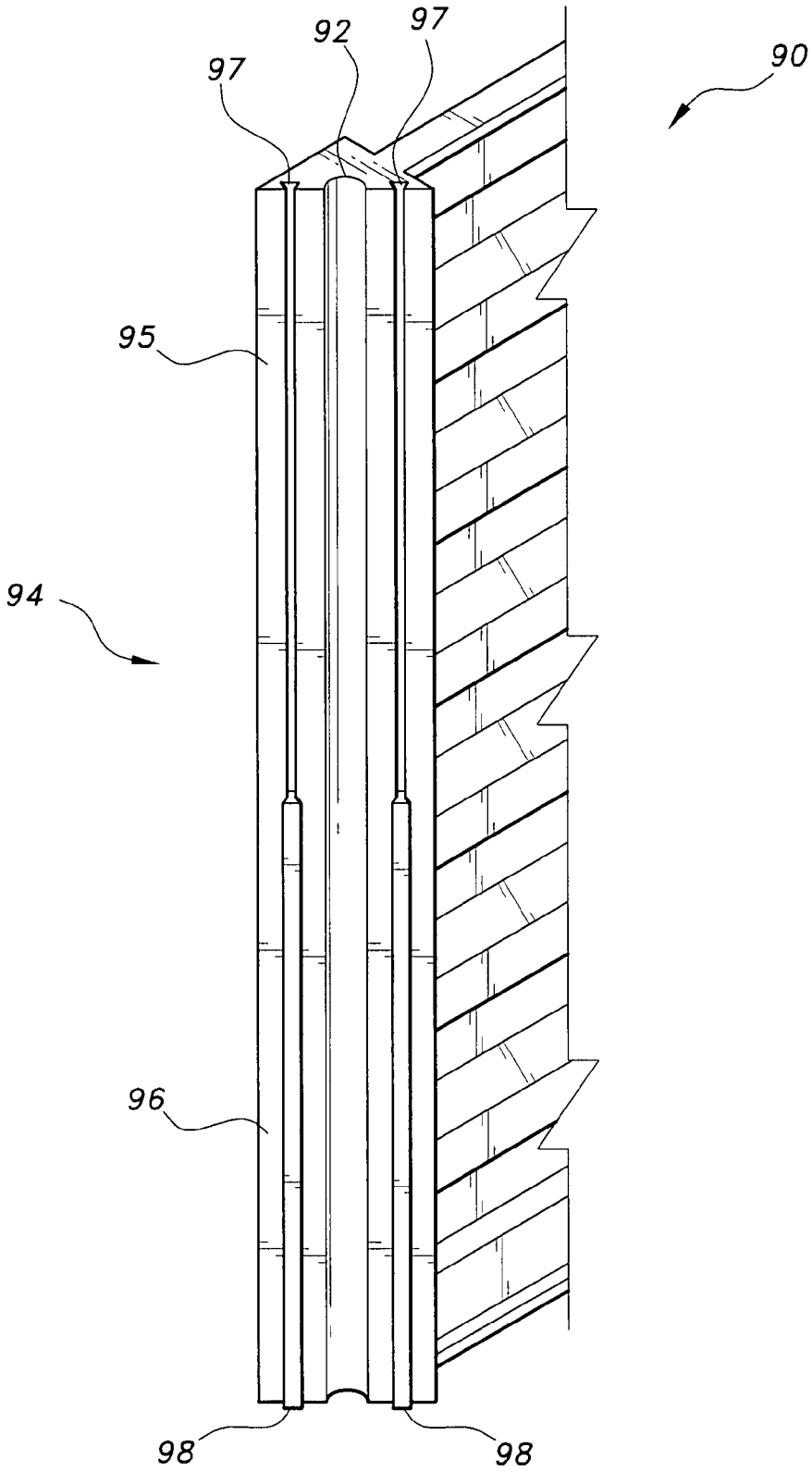
FIG. 12 is a perspective view of a fence panel according to an alternate embodiment depicting the alternating interlock mechanism.

FIG. 12 depicts an alternate embodiment of the interlocking mechanism. In this embodiment the first end 94 of a fence panel 90 is equipped with connector slots 97 and connector projections 98. The connector slots 97 are located on the top half portion 95 of the first end 94 of the panel 90. The connector projections 98 are located on the bottom half portion 96. An adjacent fence panel (not depicted) would be equipped with connector projections on the top half portion of the panel and connector slots on the bottom half portion of the panel. The interlocking mechanism depicted in FIG. 12 provides a more secure attachment of the adjacent fence panels around the fence post 20. The present embodiment also allows for easier assembly of the privacy fence system 10. In the present embodiment the fence panel 90 only has to be raised to half of the height of the adjacent fence panel. The projections 96 on each fence panel then slide into the slots 97 of the adjacent panel.

Figure 13:
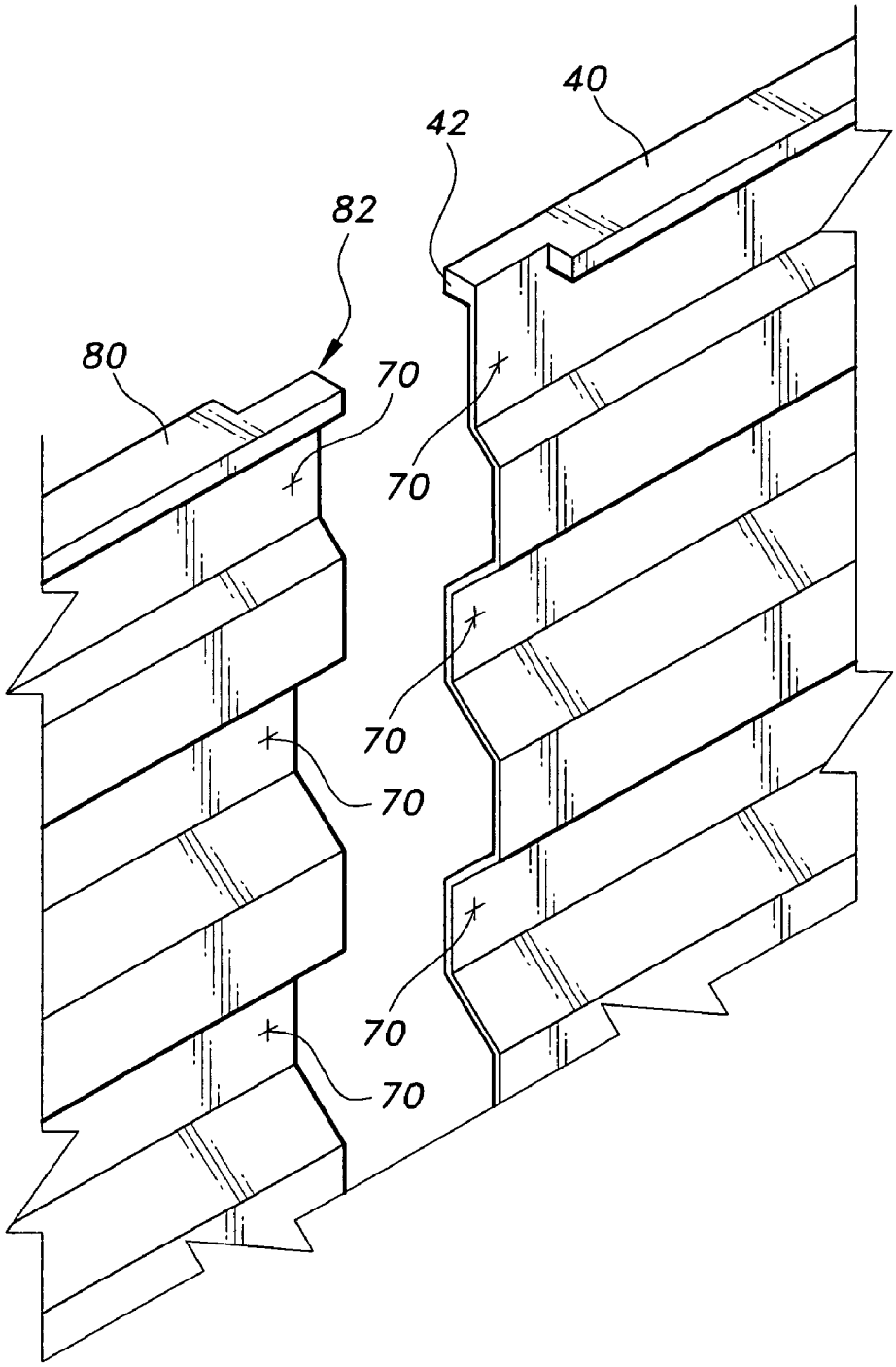
FIG. 13 is a perspective view displaying the overlapping connection of two adjacent fence panels of a horizontal corrugated design.
Figure 13A:
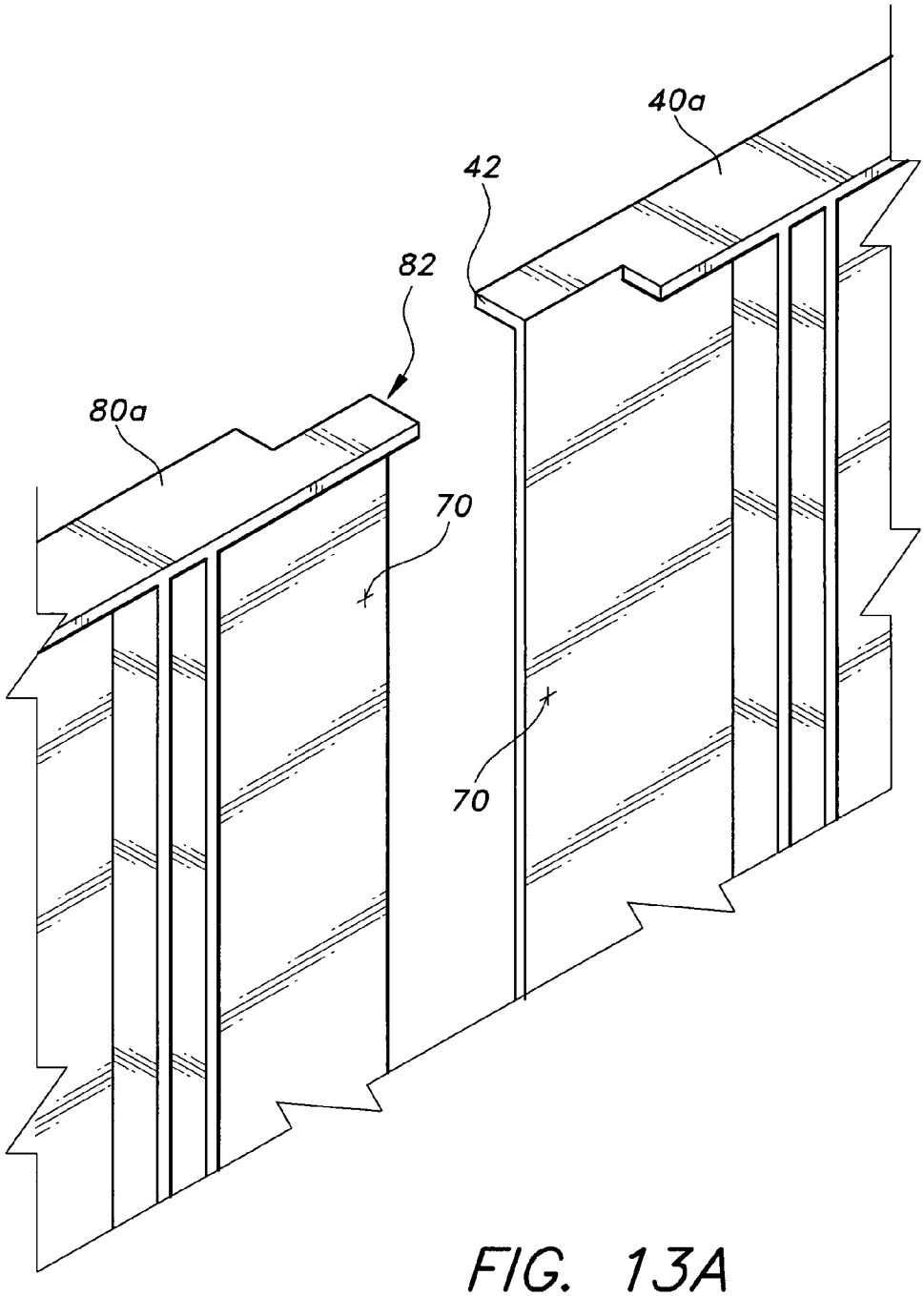
FIG. 13A is a perspective view displaying the overlapping connection of two adjacent fence panels of a vertical panel design.

FIG. 13 is a perspective view displaying the overlapping connection of two adjacent fence panels 40, 80 of the horizontal corrugated design. The distal end 42 of fence panel 40 is not adapted to fit around a fence post 20. The distal end 42 of the fence panel 40 is adapted to be releasably secured to the distal end 82 of another adjacent fence panel 80. The fence panel 40 overlaps the adjacent fence panel 80 and is releasably secured to the adjacent panel 80 by an overlapping securing means. The overlapping securing means is preferably a plurality of typical pop rivets, which rivets are located along the entire height of each fence panel. The pop rivets are located on the fence panels at position 70. The overlapping securing means allows the length of the linear segments to be adapted to irregularities in the placement of the original fence posts. The adjacent fence panels 40, 80 can be altered in the distance that they overlap to compensate for fence post misplacements. If two of the original fence posts were positioned too close to one another, the adjacent fence panels 40, 80 will overlap a greater distance to effectively shrink the privacy fence system to accommodate the misplacement of the posts. In FIG. 13*a*, the overlapping feature is illustrated in fence panels 40*a* and 80*a* having a vertical design.

Figure 14:
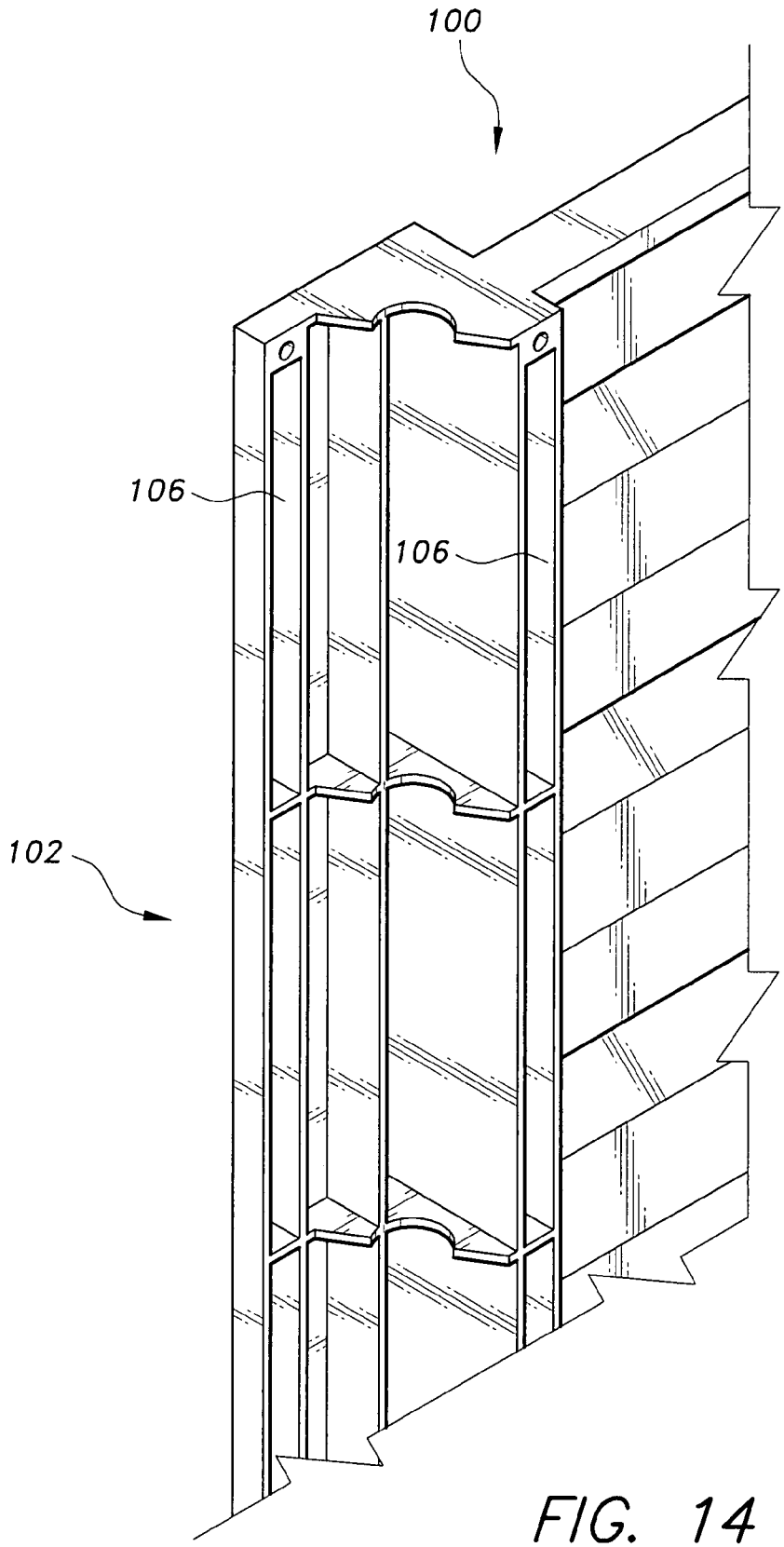
FIG. 14 is a perspective view of a molded linear segment of a horizontal corrugated panel of the preferred embodiment of the privacy fence system.

FIG. 14 is a perspective view of a molded linear segment 100 of the privacy fence system. The segment 100 is formed by pouring material into a mold to form the shape of the segment. The front portion 102 of each segment 100 includes a plurality of mold receiving slots 106. The mold receiving slots 106 receive projections inside of the mold that form the shape of the segment 100.

Figure 15:
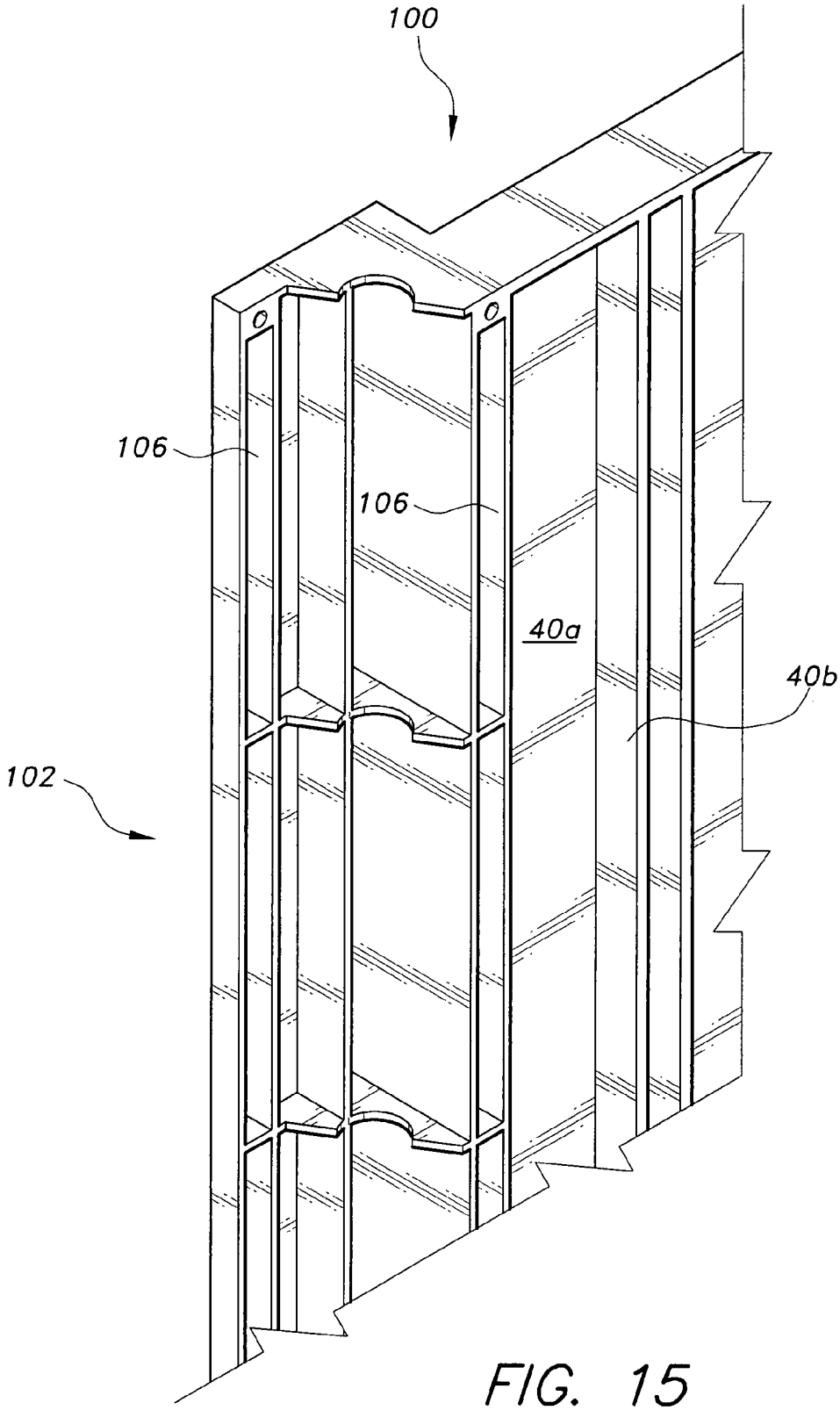
FIG. 15 is a perspective view of a molded linear segment of a vertical panel the privacy fence system.

FIG. 15 is a perspective view similar to FIG. 14 but illustrating the flat panel design as discussed above.

Figure 16:
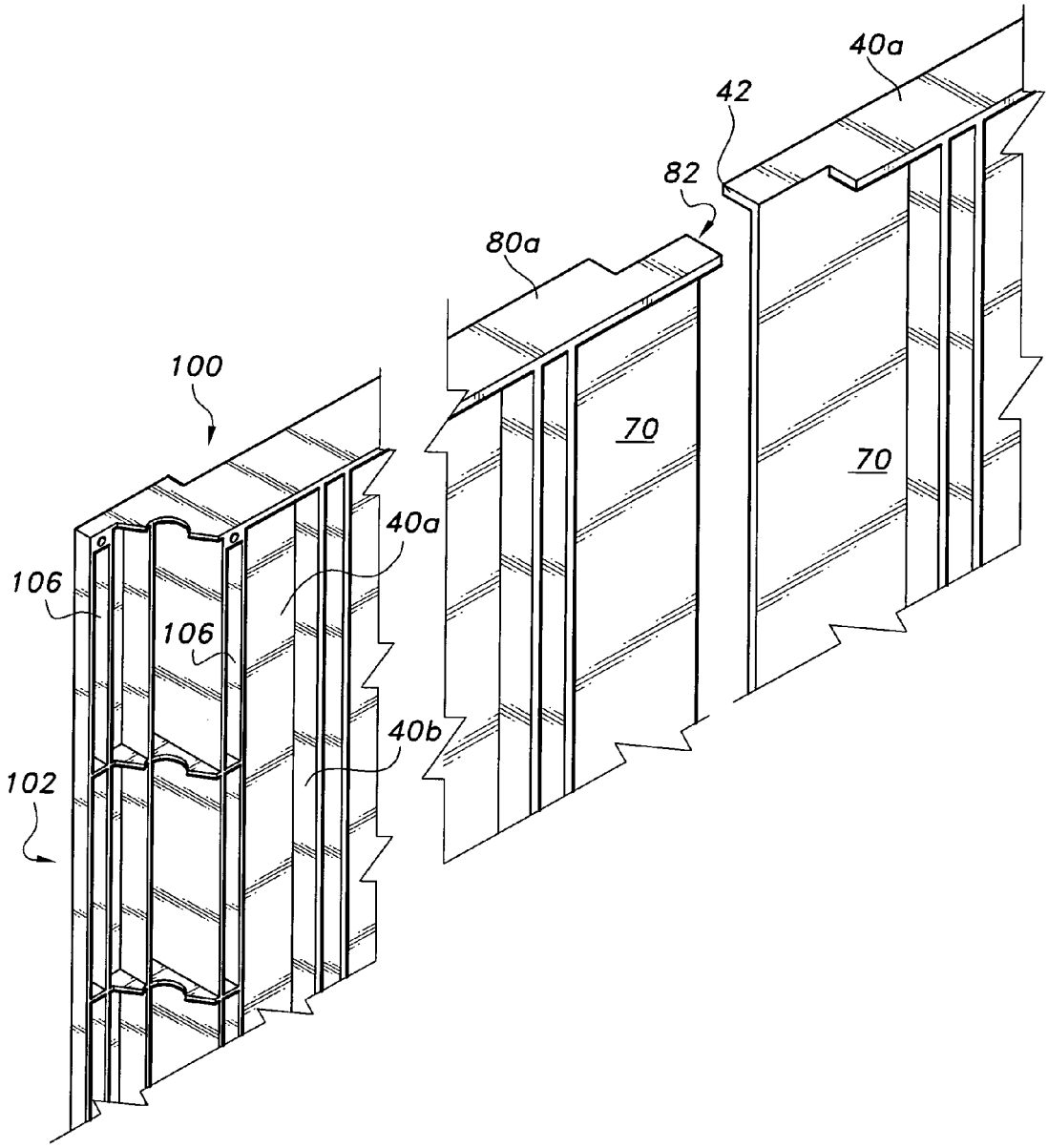
FIG. 16 is a perspective view displaying the fence panel of FIG. 13A and FIG. 15.

FIG. 16 is a perspective view depicting the fence panel as discussed separately in FIGS. 13A and 15.

The fence panels are preferably made from a light-weight, one piece, molded construction. The fence panels are preferably six feet high and have a length of 67 inches. The height of six feet allows for ten pop rivets to be positioned along the distal end of the fence panel. These dimensions, however, are only illustrative and are not meant to limit the present privacy fence system.

It is to be understood that the present invention is not limited to the sole embodiments described above, but encompasses any and all embodiments within the scope of the following claims.

The invention claimed is:

1. A barrier system having pre-existing fence posts comprising:

a first one-piece, molded fence panel presenting a continuous surface and having a first end and a second end;

a second one-piece, molded fence panel presenting a continuous surface and having a first end and a second end;

each of said first and second panels having a plurality of vertically oriented rib walls and segmented horizontal spacers formed each of said first and second ends of each said panel;

a cavity formed in each first end and being defined by said rib walls and said horizontal segments, whereby said first end of each panel is adapted to fit around a respective pre-existing fence post;

first releasable attachment structure disposed on said first end of said first fence panel;

second releasable attachment structure disposed on said first end of said second fence panel, whereby adjacent panels are adapted to be releasably secured to said respective pre-existing post; and said second end of each said first fence panel and said second end of each said second fence panel being designed and configured to be interconnected having an overlapping distal end portion configured differently than said first ends and providing a substantially planar flush fitting engagement therebetween, whereby a barrier system is formed by said plurality of first and second fence panels being connected alternately by said first ends and said second ends, respectively, with the elongated cavities formed by the post receiving slots of the connected first ends of said first and second fence panels fitted around pre-existing fence posts.

2. The barrier system according to claim 1, including a post cap releasably secured to each of said pre-existing fence posts.

3. The barrier system according to claim 1, wherein each of said first ends has a predetermined height and each of said cavities being coextensive with said height.

4. The barrier system according to claim 1, wherein said rib walls and horizontal spacers further define slots.

5. The barrier system according to claim 4, wherein each of said fence panels presents a continuous flat planar surface throughout said height and further includes a vertically oriented reinforcing strut disposed on the flat planar surface of each of said panels substantially throughout said height.

* * * * *